United States Patent [19]

Bechtel

[11] Patent Number: 5,056,254

[45] Date of Patent: Oct. 15, 1991

[54] METHOD AND APPARATUS FOR ATTACHING AN AUXILIARY AIMING DEVICE TO A SEMI-AUTOMATIC PISTOL

[76] Inventor: Daniel L. Bechtel, 4701 Inwood Rd., Fort Worth, Tex. 76109

[21] Appl. No.: 594,825

[22] Filed: Oct. 9, 1990

[51] Int. Cl.[5] ..... F41G 1/35

[52] U.S. Cl. ..... 42/103; 362/110

[58] Field of Search ..... 42/103; 362/110–114

[56] References Cited

U.S. PATENT DOCUMENTS 4,777,754 10/1988 Reynolds, Jr. ..... 42/103

4,934,086 6/1990 Houde-Walter ..... 42/103

FOREIGN PATENT DOCUMENTS 694560 12/1930 France ..... 362/110

*Primary Examiner*—Michael J. Carone

*Attorney, Agent, or Firm*—Charles W. McHugh

[57] ABSTRACT

The original recoil spring rod or guide that is present on many semi-automatic pistols is removed and replaced with a new guide that differs from the original by having a means for affixing a mount to the new guide. In one embodiment the new guide has a threaded bore in the end that is exposed at the front of the pistol. Complementary threads are provided on a bolt or machine screw, and a structural mount is configured so that is may be rigidly affixed to the guide (and thusly affixed to the frame of the pistol) by the bolt or machine screw, etc. In another embodiment, the replacement guide is significantly longer than the original guide; and the extra length that protrudes out of the front of the pistol is given external threads. A nut with complementary threads is then used to rigidly fix a mount to the frame of the pistol. In another embodiment, a shallow circumferential groove is cut into the protruding end of a replacement guide, and a spring-biased detent is provided in the mount at a location where it will engage the groove and hold the mount securely on the pistol. The mount is configured in whatever way seems to be desirable in order to best support the particular sighting aid that is to be added to the pistol. The sighting aid may be a miniaturized laser or a small flashlight, etc. The new recoil spring guide may be permanently left with the pistol, while the sighting aid may be repeatedly installed and removed as needed.

14 Claims, 1 Drawing Sheet

METHOD AND APPARATUS FOR ATTACHING AN AUXILIARY AIMING DEVICE TO A SEMI-AUTOMATIC PISTOL

BACKGROUND OF THE INVENTION

This invention relates generally to a device for attaching an auxiliary aiming device (such as a laser, scope or flashlight) to a semi-automatic pistol; more specifically, it relates to the mounting of an auxiliary aiming device to a pistol of the type that has a recoil spring guide which has a forward portion that is at least partially exposed at the front of the pistol.

It is well known that the sights that are installed on a pistol at the factory where the pistol is made do not always satisfy the owner/user of the pistol. Hence, it is common for a person who is going to shoot a pistol to replace or supplement the factory-original sights with an auxiliary sighting device such as a scope. It is also common for shooters to attach accessory lights to their pistols, when the pistols are to be fired at night or in a low-light environment. Such lights may constitute small but powerful battery-operated flashlights which illuminate the field of view for a shooter, so that the shooter may then utilize the pistol's original "iron" sights or some other auxiliary sighting device. Accessory lights may also be of the laser type, in which a beam of light is projected from the pistol in a direction that is parallel to the bore, so that the shooter will know exactly where the pistol is pointed.

With regard to the pistols to which a shooter might wish to attach one of the above-described aiming devices, there are two principal types of pistols that are made and sold by major commercial manufacturers: revolvers and semi-automatics. This invention is broadly concerned with the second type, which are sometimes referred to by the abbreviated, though technically incorrect terms, "autos" or "automatics." More specifically, this invention is concerned with those semi-automatic pistols which are characterized by the presence of a recoil spring that is compressed by the recoiling action of the pistol's barrel, slide 58 when the pistol is fired. After a given round has been fired, the potential energy that is captured during the compression of the coiled spring is recovered by allowing the spring to expand. The expanding spring drives the barrel and/or breechblock forward with a fresh round, rendering the pistol again ready for firing when the trigger is pulled a subsequent time. A typical recoil spring is usually restricted to a very tightly controlled movement within a pistol by a rigid guide or rod, which usually fits internally of the coiled spring for much—if not all—of its length.

While it seems that modern reference books usually give adequate basic information about semi-automatic pistols, it will be necessary in this disclosure to call attention to a feature of modern semi-automatic pistols that is not universal. The feature that is of interest, and which is critical to utilization of the teachings herein, is that some pistols have a recoil spring guide that is completely concealed within the pistol's frame or housing, while other pistols have a recoil spring guide whose frontal portion is at least partially exposed at the front of the frame. The difference (at least as far as this invention is concerned) is significant, but thus far it has seemingly been ignored in the literature-probably because it didn't really seem to have any impact with regard to either the operation of the pistol or what a person could do with the feature. The difference in how a recoil spring guide is structured is not a concealed difference, and it is not even very hard to discover when a given pistol is available for examination. So perhaps in the future, writers who are describing a particular pistol will begin to communicate a significant bit of information to readers by mentioning whether the guide is of one type or the other.

This invention is concerned only with those pistols in which a frontal portion of the recoil spring guide is at least partially exposed, or can be easily altered to be exposed, when the pistol is assembled for firing. Within this category are pistols such as the Glock 17, Smith & Wesson 59, SIG 226, Beretta 92F, Ruger P85, and Smith & Wesson 3913 (also known as the "lady Smith"). It should be understood that this list is not meant to be an all-inclusive list; rather, it is intended to be exemplary-and to demonstrate that both U.S. and foreign manufacturers are producing semi-automatic pistols which are capable of utilizing the invention described herein. In all of the pistols to which this invention is applicable, it would be accurate to say that the recoil spring guide is fixed, anchored or "grounded" to the pistol's frame in some manner, such that the guide does not move with the slide, barrel or breechblock in response to the firing of a round. The only other critical characteristic of applicable pistols is that a frontal portion of the guide must be normally exposed when the pistol is assembled for firing. When these two features are present in a pistol, the pistol can be enhanced by attaching thereto an auxiliary aiming device of any of a variety of shapes, sizes, etc., by removing the original recoil spring guide and replacing it with a new guide that provides any of a variety of beneficial features-as will now be explained, with appropriate reference to the figures of the drawing provided herewith.

BRIEF DESCRIPTION OF THE INVENTION

Figure 1:
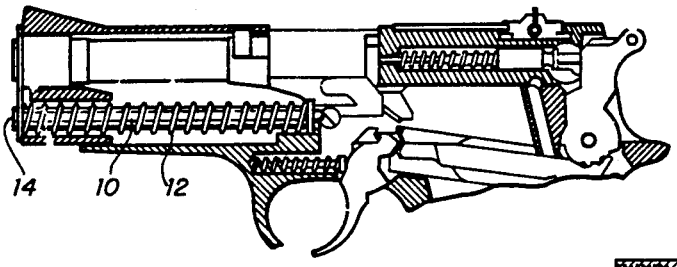
PRIOR ART FIG. 1
FIG. 1 is a cross-sectional elevationed view of an exemplary semi-automatic pistol of the prior art, and showing only the upper portion of the pistol which is useful in obtaining an understanding of the invention.

In brief, the invention involves removing the original recoil spring rod or guide that is present on many semi-automatic pistols—and replacing it with a new guide that differs from the original by having a means for affixing a mount to the new guide. In one embodiment the new guide has a threaded bore in the end that is exposed at the front of the pistol. Complementary threads are provided on a bolt or machine screw, and a structural mount is configured so that it may be rigidly affixed to the guide (and thusly affixed to the frame of the pistol) by the bolt or machine screw, etc. In another embodiment, the replacement guide is significantly longer than the original guide; and the extra length that protrudes out of the front of the pistol is given external threads. A nut with complementary threads is then used to rigidly fix a mount to the frame of the pistol. In another embodiment, a shallow circumferential groove is cut into the protruding end of a replacement guide, and a spring-biased detent is provided in the mount at a location where it will engage the groove and hold the mount securely on the pistol.

The mount itself is configured in whatever way seems to be desirable in order to best support the particular sighting aid that is to be added to the pistol. A very popular sighting aid at this time is one of the minaturized lasers that is now being offered in the commercial market, and an exemplary mount will bw shown and described herein. Alternatively, the mount may be configured to hold a small flashlight under the barrel or a scope over the barrel, etc. By using a single mounting screw with a knob that can be manually tightened and loosened, a given mount can be quickly removed and replaced with a different mount that holds an auxiliary sighting aid of a different type, or holds a replacement aid of the same type. Depending on the size of the knob and the leverage that can be obtained by turning it, installation and removal of a mount can be accomplished without the use of any tools. And since the substitution of the new recoil spring guide requires no machining work or the like, the system described herein may aptly be categorized as a no-gunsmithing system.

There may also be circumstances in which a pistol is owned by some governmental agency such as a police department, while a sighting aid such as a laser is owned by the police officer to whom the pistol has been assigned. Using the system described herein, the pistol may be modified—with the consent of the department—by switching a new guide for the original one. The pistol may then be left in the custody of the department at prescribed times, while the officer keeps the privately owned laser in a shirt pocket. When the time comes to take the pistol into the field, the officer can quickly install the laser onto the new guide, and the pistol will be ready for duty in a matter of a few seconds. Even though the pistol has been converted to accept a mount as described herein, the pistol is not otherwise affected; and anyone can pick it up and use it in a conventional manner without adding (and obtaining the benefit of) an auxiliary aiming device.

DETAILED DESCRIPTION OF A PREFERRED EMBODIMENT

Referring initially to FIG. 1, an exemplary semi-automatic pistol is partially shown, in cross-section, to illustrate how a recoil spring guide of the prior art is anchored to the frame of the pistol. The guide 10 is held against any transverse movement at its rear, and is precluded from longitudinal movement by some kind of structure in the front. The recoil spring 12 (also sometimes called the operating spring) is "telescoped" over the guide 10, in order that the spring's movement will be tightly controlled during firing of the pistol, etc. As is clearly visible in the drawing, a forward portion of the guide 10 is exposed at the front of pistol. This forward portion 14 is visible at the front of the pistol when it is assembled for firing, but it would be fair to say that the forward portion has thus far been mostly non-functional. Hence, the forward portions of recoil spring guides have been given little attention by casual observers, and most written material about pistols is essentially silent about whether the forward end of a particular guide is exposed or concealed.

Figure 3:
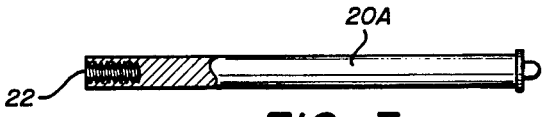
FIG. 3 is an elevational view, partially sectioned, showing a replacement guide similar to the one that is illustrated in FIG. 2.
Figure 2:
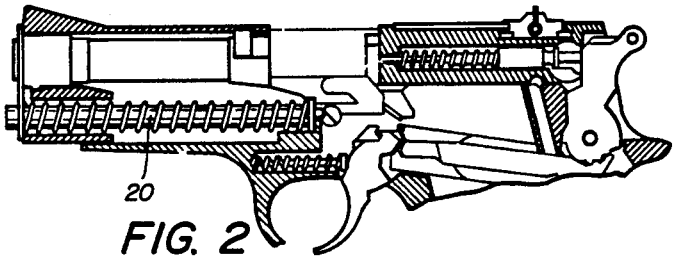
FIG. 2 is a cross-sectional elevationed view similar to FIG. 1, and showing the original recoil spring guide removed and replaced with a guide in accordance with the invention.

Referring next to FIGS. 2 and 3, the guide that came with the pistol as an O.E.M. part has been removed and replaced with a new guide 20 that is generally the same shape and length as the original guide—but which has a longitudinally extending bore at its forward end. The abbreviation O.E.M., of course, will be understood to mean "original equipment manufacturer," and is used here as a shortened way of describing a given part that is the same as the part that was designed for the pistol by the original manufacturer. A given O.E.M. part may not have ever been manufactured by the company that originally sold the pistol, just like most automobile manufacturers do not produce the tires that are on automobiles as they roll off the assembly line. But at least the O.E.M. notation gives everyone a standard of reference when referring to the size, shape, or quality of a manufactured part that is used in some assembly. So if a part of any assembly is ever replaced because of wear or breakage, and the replacement part is said to meet O.E.M. specifications for that part, then the assembly may be thought of as having been returned to its original condition—at least as far as the replaced part is concerned.

Referring specifically to FIG. 3, a replacement guide 20A is shown in elevation; this particular guide is intended to replace the original guide for a Glock pistol. The replacement 20A has a total length of 3.188 inches, which is at least as long as the original guide and may be slightly longer. A replacement guide that is longer than the original is not a problem, because the extra length will be protruding out into empty space in front of the trigger guard, and will not interfere with internal operation of the pistol. Unlike the original Glock guide, which is made of plastic, the replacement 20A is manufactured of a structurally significant material such as 303 stainless steel. The strength of steel is desirable because the forward end of the guide 20A has a longitudinal bore with internal threads 22, and it is these threads that are engaged by a screw or bolt in order to support a structural mount for a sighting aid with respect to the pistol. The threads 22 are preferably rather fine, e.g., 10–32 threads in a bore made with a No. 21 tap. After the bore has been drilled, there is sufficient wall thickness remaining in a guide 20A whose diameter is at least one-fourth inch to support a mount and any sighting aid that would reasonably be attached to a pistol.

Figure 4:
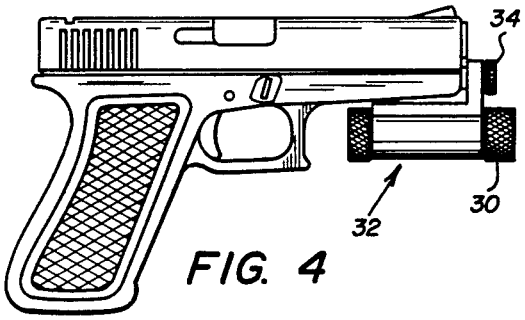
FIG. 4 is a side elevational view showing an auxiliary aiming device attached to a pistol, said device being in the form of a small laser mounted below the barrel and in front of the trigger guard.
Figure 5:
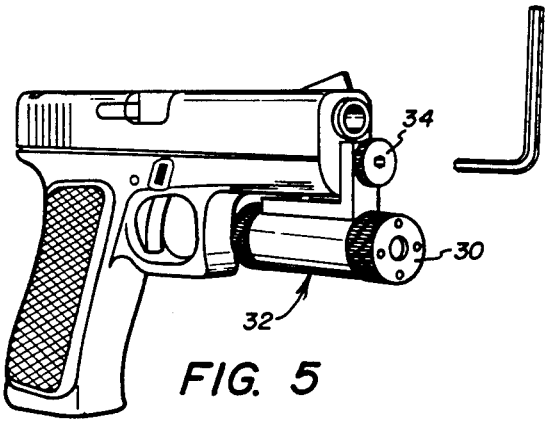
FIG. 5 is a perspective view of an embodiment of the invention like that shown in FIG. 3.

Turning next to FIG. 4 an aiming device in the form of a small laser 30 is shown as it would typically be held by a rigid mount 32, so that the laser will be generally parallel to the bore of the pistol to which it is attached. When installed, the laser will be under the barrel of the pistol, in a manner similar to the device that is shown in U.S. Pat. No. 4,777,754 to Reynolds; but a mounted laser in accordance with this invention will be closer to the barrel, because it is anchored to the recoil spring guide instead of to the trigger guard. FIG. 5 shows another view of the assembly shown in FIG. 4. Of course, the knurled knob 34 constitutes the visible part of a means for connecting the laser mounting bracket 32 to the now-hidden guide 20A; a concealed part of the connecting means is the threaded member that projects from the knob and engages the threads 22. When the brack 32 is connected to a guide 20A, a sighting aid will be securely connected to the frame of the pistol. But at any desired time, removal of the single knob 34 will release the mount 32, so that the sighting aid can be quickly and easily removed from the pistol. And by making the diameter of the knob 34 between about three-quarter and one inch, enough torque can usually be applied by a person's fingers to obtain an installation that is more than adequate to withstand the recoil loads that are generated as the pistol is fired. Alternatively, a hex-shaped recess may be provided in the exposed face of a knob, said recess being concentric with the knob and being sized to be engaged with a conventional Allen-head wrench. By manipulation of a single wrench, the mount can be repetitively installed and removed from a pistol.

During installation and removal of a mount in accordance with this invention, the pistol is never rendered inoperative; so a policeman or other person who may be relying of the pistol for self-defense is never rendered vulnerable as he manipulates his sighting aid. That is, once the original guide has been removed and replaced with a new guide in accordance with this invention, a mount 32 (and its associated sighting aid) can be installed and removed without in any way affecting operation of the pistol. So if a policeman is interrupted halfway through the process of installing a laser or the like, his pistol will still be operative and can still be used.

This is probably an appropriate time to mention some other characteristics about the mounting of auxiliary sighting aids onto pistols. There are actually several considerations that a prudent designer takes into account when deciding how to combine a pistol with an auxiliary sighting aid. First, the sighting aid should be easy to install; if at all possible, installation should be achievable without requiring the services of a professional gun-smith. The object here is not to deprive gunsmiths of a reasonable livelihood, but rather to avoid the hassle of having to deliver a pistol to a reliable gunsmith (who may work many miles from the owner's location) and then make a second time-consuming trip some time later to pick up the finished pistol. Of course, the time period during which the owner and his pistol are separated can be a further frustrating thing—which is avoided if the owner can do the work himself.

Additionally, it is desirable that the mechanical operation of a pistol be unaffected by installation of an auxiliary sighting aid. This is important for two reasons: first, the owner probably purchased the pistol for use—rather than as a decoration to hang on a wall; so anything that interferes with use is a negative. Second, any structural alteration of a pistol (by drilling mounting holes or the like) may have some impact on safety and may affect any warranty that is provided by the manufacturer or seller. Furthermore, many people consider the original "new, in the box" condition of a firearm to be so desirable that it is often worth many dollars in the resale price of a pistol if it can be restored to is original condition—after an auxiliary sighting aid has been removed by the first owner. Hence, the ability to quickly and easily install a replacement guide 20A without making any alteration in the pistol's frame, etc., constitutes a significant advantage of the invention disclosed herein. On the other hand, if a person is willing to forgo the advantages described above, it would be technically possible to take a recoil spring guide that is normally concealed completely within a center-fire and cut away enough of any non-structural cover in order to expose the forward end of the guide. A replacement guide with a threaded bore (as described above) could then be substituted for the original guide, thereby placing the pistol in condition to receive an auxiliary sighting aid as described herein.

Figure 6:
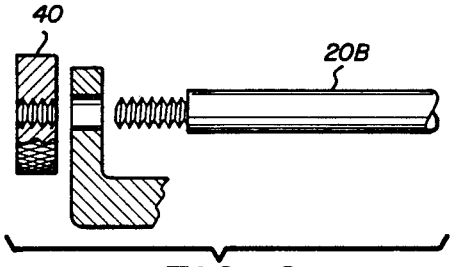
FIG. 6 is a fragmentary elevational view of an alternate embodiment of the invention in which the replacement guide has male threads on an extended portion that protrudes forwardly from the frame.

Referring next to FIG. 6, another embodiment of the invention functionally equivalent to the embodiment shown in FIG. 3, but the placement of the threads is reversed. Instead of providing exterior (or "male"threads on a bolt that engages interior threads on the guide 20A, the exterior threads are provided on a recoil spring guide 20B. The guide 20B is, of course, made somewhat longer than the O.E.M. guide, and the extra length causes the forward end of the guide 20B to project in a cantilevered manner in front of the pistol. A knob 40 with internal threads that complement the threads on giide 20B may then be affixed to the guide through the simple and easy action of engaging two threaded members. A rigid mount for holding some auxiliary sighting aid has a structural projection with a smooth bore that provides a slip fit over the protruding extention of guide 20B. By first engaging the projection with the body of guide 20B and then adequately tightening the knob 40, the projection will be captured and the sighting aid will be secured to the pistol's frame. If the sighting aid is a flashlight that simply illuminates the field of view in front of the pistol, no careful adjustment of the orientation of the flashlight would likely be necessary. If the sighting aid is a laser, appropriate adjustments would normally be made in order to ensure that the laser will project a beam of light in front of the pistol in a direction generally parallel to the barrel. Once such adjustments are made, the sighting aid can be alternatively attached to and removed from engagement with the guide 20B without affecting such adjustments—because installation is always accomplished in a direction that is parallel to the pistol's bore. So, depending upon varying requirements, a shooter on a firing range or in the field, etc., would be able to replace one mount with another, without using any special tools or rendering the pistol temporarily inoperative. A shooter could therefore replace a defective scope, exchange one laser for another, or add a flashlight for nighttime illumination—using only a singular threaded means.

Figure 7:
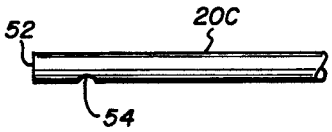
FIG. 7 is a fragmentary elevational view of an embodiment in which a replacement guide has a forwardly extending portion with no threads but with a shallow groove into which a detent may be forced in order to lock a mount to the frame of a semi-automatic pistol.

Referring next to FIG. 7, the body 50 of a replacement guide 20C is made sufficiently long that a frontal portion 52 will project in a cantilevered fashion in front of the pistol when the guide is installed. In this frontal portion 52 there is placed a shallow groove or recess 54 which is oriented so that it is in a plane that is transverse to the longitudinal axis of the guide. The width and depth of the groove is sized so that it may receive and hold a spring-loaded detent that is carried by the latching portion of a mounting bracket for an auxiliary sighting aid. The detent normally projects a small distance into a bore in the latching portion, said bore being sized and located in order to foster a tight fit with the frontal portion 52. In view of the fact that the forward portion 52 is designed to mate with a bore, and the tightness of this mating will have an impact on the precision with which a sighting aid will be mounted on a pistol, the length of the forward portion and the clearance between said portion and the bore will be selected when the type, weight and size of the sighting aid are known. In general, it may be anticipated that the forward portion 52 will have a length of at least ¼ inch, and about ⅜ to ½ inch will be more common; the clearance between the two mating elements will be no more than about 0.005 inch. Of course, the precision with which a scope is to be mounted (above the barrel) or a laser is to be mounted (below the barrel) will be greater than that normally required for mounting a short-range flashlight. And the greater length of engagement between the forward portion and the bore, the greater can be the clearance between them before error might begin to be apparent in the alignment of a sighting aid with respect to a pistol's bore.

Having described three alternative embodiments of the invention, including the preferred embodiment shown in FIG. 3, it should now be apparent to persons skilled in the art that the easy-on/easy-off technique for mounting a sighting aid on a semi-automatic pistol may take various forms. And no doubt modifications and variations of the three embodiments disclosed herein will be recognized by such persons as being structurally adequate, once the concept of anchoring a sighting aid to a recoil spring guide is fully appreciated. Hence, it should be understood the inventive concept may be applied in several ways, all of which are intended to be encompassed by the claims. Therefore the invention should be understood to be measured only by the scope of the appended claims.

What is claimed is:

1. An article of manufacture having utility in mounting an auxiliary aiming device on a semi-automatic pistol when the pistol is of the type having a recoil spring guide that has a fixed position which is adjacent and generally parallel to the pistol's barrel, and wherein the recoil spring guide has a portion that is exposed at the front of the pistol when the pistol is assembled for firing, comprising:

a. a rigid body having the gereral configuration of the original O.E.M. recoil spring guide, said rigid body having a first end that is configured to engage a structural portion of the pistol for holding the recoil spring in an operative position, and said rigid body having a second end with a portion that is at least partially exposed when the rigid body is inserted in a pistol as a substitute for the original O.E.M. recoil spring guide;

b. a mounting bracket for supporting an auxiliary aiming device with respect to a pistol; and c. means for connecting the mounting bracket to the rigid body.

2. The article as claimed in claim 1 wherein the means for connecting the mounting bracket to the rigid body comprises a threaded means.

3. The article as claimed in claim 2 wherein the threaded means includes a threaded bore in the second end of the rigid body, and further including a complementary threaded member which is effective to rigidly secure the mounting bracket to the rigid body.

4. The article as claimed in claim 3 wherein the threaded bore is concentric with the longitudinal axis of the rigid body, said longitudinal axis extending from the first end to the second end of the rigid body, and the complementary threaded member has a length of at least one-forth inch and 10–32 external threads.

5. The article as claimed in claim 1 wherein the means for fixedly connecting the mounting bracket to the rigid body is repeatedly connectable to and removable from the pistol by manipulation of a single element, after the rigid body has been installed in a pistol.

6. The article as claimed in claim 5 wherein the single element that is manipulated to connect and remove a mounting bracket is a wrench, whereby the mounting bracket may be manually installed onto and removed from a pistol by use of a single wrench.

7. The article as claimed in claim 1 wherein the means for connecting the mounting bracket to the rigid body includes a cantilevered element that extends outwardly from the second end of the rigid body and beyond the original profile of the pistol.

8. The article as claimed in claim 7 wherein the cantilevered element extends in a direction that is generally parallel to the longitudinal axis of the body, said longitudinal axis extending symmetrically of the body and between its first and second ends.

9. The method of mounting an auxiliary aiming device onto a semi-automatic pistol of the type having a recoil spring and a guide that secures the recoil spring with respect to the pistol's frame, and said guide having a first end that is secured to the frame interiorly of the pistol, and said guide having a second end that is exposed near the front of the pistol, comprising the steps of:

a. removing the original O.E.M. recoil spring guide from the pistol and substituting therefor a rigid body having the general shape and approximate size of the O.E.M. recoil spring guide, said rigid body having a first portion that is adapted to fit internally of the pistol and interact with the pistol's frame to establish a fixed platform for supporting the recoil spring, and said rigid body having a second portion that is at least partially exposed near the front of the pistol when the rigid body is installed in a pistol; and b. attaching a mount for an auxiliary aiming device to the second portion of the body.

10. The method as claimed in claim 9 wherein the rigid body is substituted for the O.E.M. recoil spring guide and permanently left with the pistol as an integral part thereof, and wherein the mount for an auxiliary aiming device is repeatedly attached to the rigid body and then removed therefrom, depending upon varying requirements for the use of an auxiliary aiming device.

11. The method as claimed in claim 9 wherein the step of attaching a mount to the rigid body is achieved with threaded means.

12. The method as claimed in claim 9 wherein the step of attaching a mount to the rigid body is achieved by engaging a bore in one element with a protrusion that forms a rigid extension of the other element.

13. The method as claimed in claim 12 wherein the bore is provided in the rigid body, and the step of attaching the mount is achieved by inserting the protrusion into the bore, said protrusion extending rearwardly with respect to the auxiliary aiming aid that is being mounted on the pistol.

14. The method as claimed in claim 9 wherein the auxiliary aiming aid is a laser having a weight of not more than 3 ounces, and the auxiliary aiming device is attached to the pistol with a single threaded member that is tightened from the front of the pistol with a wrench.

* * * * *